US006772819B2

(12) United States Patent
Shiose et al.

(10) Patent No.: US 6,772,819 B2
(45) Date of Patent: Aug. 10, 2004

(54) CASTING MACHINE AND METHOD USING HORIZONTALLY SPLIT TYPE METAL MOLDS

(75) Inventors: Fumikazu Shiose, Toyokawa (JP); Yukiyoshi Funakoshi, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 0 days.

(21) Appl. No.: 10/173,845

(22) Filed: Jun. 19, 2002

(65) Prior Publication Data

US 2002/0195224 A1 Dec. 26, 2002

(30) Foreign Application Priority Data

| | | |
|---|---|---|
| Jun. 20, 2001 | (JP) | 2001-187116 |
| Dec. 13, 2001 | (JP) | 2001-379474 |
| Apr. 24, 2002 | (JP) | 2002-122031 |
| May 7, 2002 | (JP) | 2002-131104 |

(51) Int. Cl.[7] ..... B22D 18/04; B22D 18/08; B22D 33/04

(52) U.S. Cl. ..... 164/4.1; 164/119; 164/137; 164/154.2; 164/306; 164/342

(58) Field of Search ..... 164/119, 306, 164/312

(56) References Cited

U.S. PATENT DOCUMENTS

| | | | | |
|---|---|---|---|---|
| 4,993,474 A | * | 2/1991 | Uchida | 164/326 |
| 5,269,364 A | | 12/1993 | Murata | 164/309 |
| 5,671,799 A | | 9/1997 | Merrill | 164/151 |

FOREIGN PATENT DOCUMENTS

| | | |
|---|---|---|
| JP | 52-150732 | 12/1977 |
| JP | 52-150734 | 12/1977 |
| JP | 52-150735 | 12/1977 |
| JP | 63-273561 | 10/1988 |
| JP | 6-320250 | 11/1994 |

OTHER PUBLICATIONS

Abstract of Japanese Patent No. 1–293964, published Nov. 27, 1989.

* cited by examiner

*Primary Examiner*—Kuang Y. Lin

(57) ABSTRACT

A casting machine is provided for producing an as-cast product by using horizontally split type metal molds, which are closed and held horizontally to define a cavity, and by pouring molten metal from a holding furnace into the cavity. The casting machine includes a metal drag held horizontally at a fixed position; a plurality of upwardly-facing cylinders disposed around the metal drag and mounted on a floor or a base, each cylinder having a cylinder rod that extends and retracts; and a cope die base mounted for vertical movement on the distal ends of the cylinder rods of the upwardly-facing cylinders for horizontally holding a metal cope at a position above the metal drag so that the metal cope is mated with the metal drag to define the cavity when the cope die base is lowered by the upwardly-facing cylinders.

12 Claims, 7 Drawing Sheets

CASTING MACHINE AND METHOD USING HORIZONTALLY SPLIT TYPE METAL MOLDS

FIELD OF THE INVENTION

This invention relates to an apparatus and a method for producing an as-cast product by using horizontally split type metal molds and a holding furnace as in low pressure casting, vacuum casting, or different pressure casting.

DESCRIPTION OF THE PRIOR ART

Casting machines using a holding furnace are well known, as, for example, in JP, A, 63-273561. A conventional casting machine described in that Japanese patent is shown in FIG. 9. The casting machine 101 includes four supporting columns 102, which constitute an outer frame, with each column of the frame being fixedly mounted on a base 103. A truck 104, which carries a holding furnace 105, runs along the base 103. The machine has a cylinder 107 mounted on the top of the supporting columns 102 for supporting a metal cope 106 from above.

The casting machine has some problems. The first is that since the cylinder 107 is mounted on the tops of the columns 102, the casting machine has a high profile. Thus a normal-size lorry cannot carry the entire casting machine when it is at its full height. Accordingly, when transferred by such a lorry, the casting machine has had to be divided, or disassembled, into two pieces, i.e., an upper portion and a lower portion, or three pieces. Assembling these pieces requires much labor and time.

The second is that since the machine uses an upwardly-facing cylinder on the tops of the columns 102, the machine must use many parts. Inherently it does not have enough force to demold an as-cast product that requires a large demolding force.

The third is that since the machine uses a single cylinder for lifting the metal cope, the cope cannot be held horizontally when lifted. Further, the cope cannot be adjusted, or compensated for, to be in a horizontal position when it is not held horizontally during the vertical movement. Accordingly, due to an inadequate mating (or closing) of molds, the molten metal, which is now poured into the molds, may escape from the molds at the joint between them and may cover a part of the molds. Thus, an undesired shape of a product may be produced, and the escaped metal, which covers the molds, may make it difficult to demold the product, thereby stopping the operation of the cylinder or producing scratches on the surface of the product.

SUMMARY OF THE INVENTION

The present invention has been conceived in view of the problems described above. The purpose of the invention is to provide a low-profile casting machine that uses horizontally split type metal molds and a holding furnace, wherein the metal cope is held horizontally when moved vertically and when mated with a horizontally held metal drag.

Another purpose of the invention is to provide a method to operate the casting machine of the invention.

In one aspect of the casting machine of the invention for producing an as-cast product by using horizontally split type metal molds to be closed to define a cavity and by pouring molten metal from a holding furnace into the cavity, the machine includes a metal drag fixedly and horizontally located; a plurality of upwardly-facing cylinders mounted on a floor or a base around the metal drag, each cylinder having a cylinder rod that extends and retracts; and a cope die base mounted for vertical movement on the distal ends of the upwardly-facing cylinders for horizontally holding a metal cope at a position above the metal drag so that the metal cope is mated with the metal drag to define the cavity when the cope die base is lowered by the cylinders.

The casting machine may be provided with means for detecting whether the metal cope is held horizontally by measuring the displacement of the metal cope, at some horizontally different positions, from a predetermined position or from set patterns for mold closing and mold opening. The casting machine may also be provided with means for adjusting the extension or retraction of the cylinder rods of the upwardly-facing cylinders to horizontally hold the metal cope when it is not held horizontally.

In one example of the above aspect, the cope die base may be connected to distal ends of the cylinder rods through releasable clampers, each of which has a low profile. Releasing these dampers is easily performed, and it allows the cope die base to expand or contact freely when it is subjected to heat stresses while being supported by the upwardly-facing cylinders. This releasing also allows the cope die base to be separated easily from the upwardly-facing cylinder, if desired, for transporting it.

In the present invention a "casting machine" generally means a machine for producing an as-cast product by using a holding furnace from which molten metal is poured into the cavity defined by metal molds, as in low pressure casting, vacuum casting, or different pressure casting. Further, set patterns for mold closing and mold opening mean a schedule for the intended displacement of a cope from a predetermined position over time.

If the casting machine of the present invention is provided with lifting cylinders located under the holding surface for vertically moving it, the machine will have an advantage in that it will be more compact than a conventional casting machine that uses a jack located at a lower frame to lift the holding furnace toward the metal molds.

Further, in the present invention the cylinders may be oil hydraulic, pneumatic, or electric (servomotor-driven) cylinders. If the cylinders are electric cylinders, the structure of the casting machine will have an advantage in that it will be simple, because oil hydraulic and pneumatic cylinders require some pipes and pressure pumps for the working fluid.

According to the casting machine of the present invention, it does not require such an upper frame structure that is required in the conventional machine discussed above. Thus the casting machine of the present invention can be of a low profile and of less weight.

Other purposes, aspects, examples, and advantages of the present invention will be apparent by the following description made by reference to the accompanying drawings.

DESCRIPTION OF THE PREFERRED EMBODIMENTS

Below the embodiments of the present invention are explained. In the embodiments the same or similar numbers are used for the same or similar elements.

Figure 1:
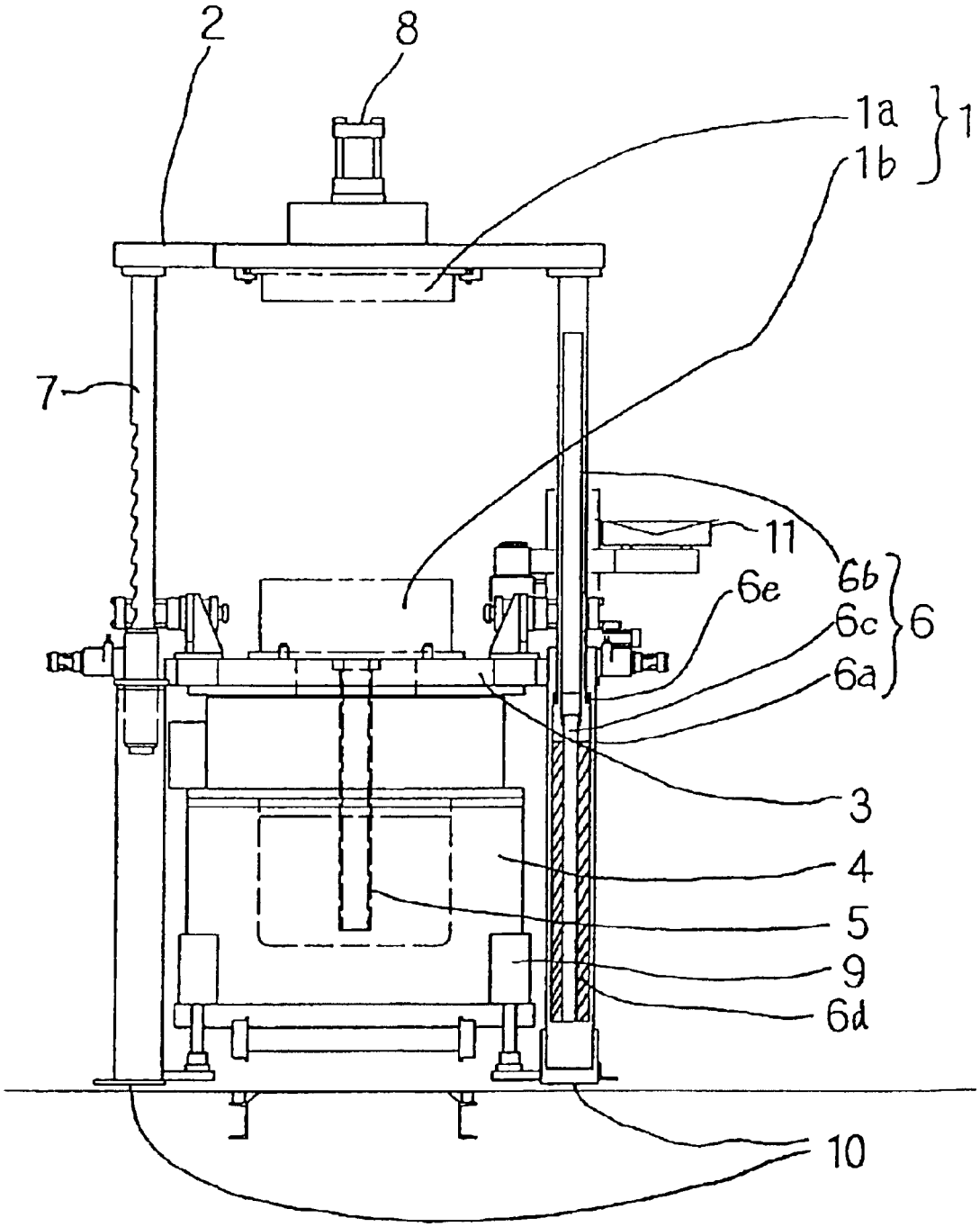
FIG. 1 is a front view of a first embodiment of the casting machine of the present invention, showing the metal molds of the machine being opened.
Figure 2:
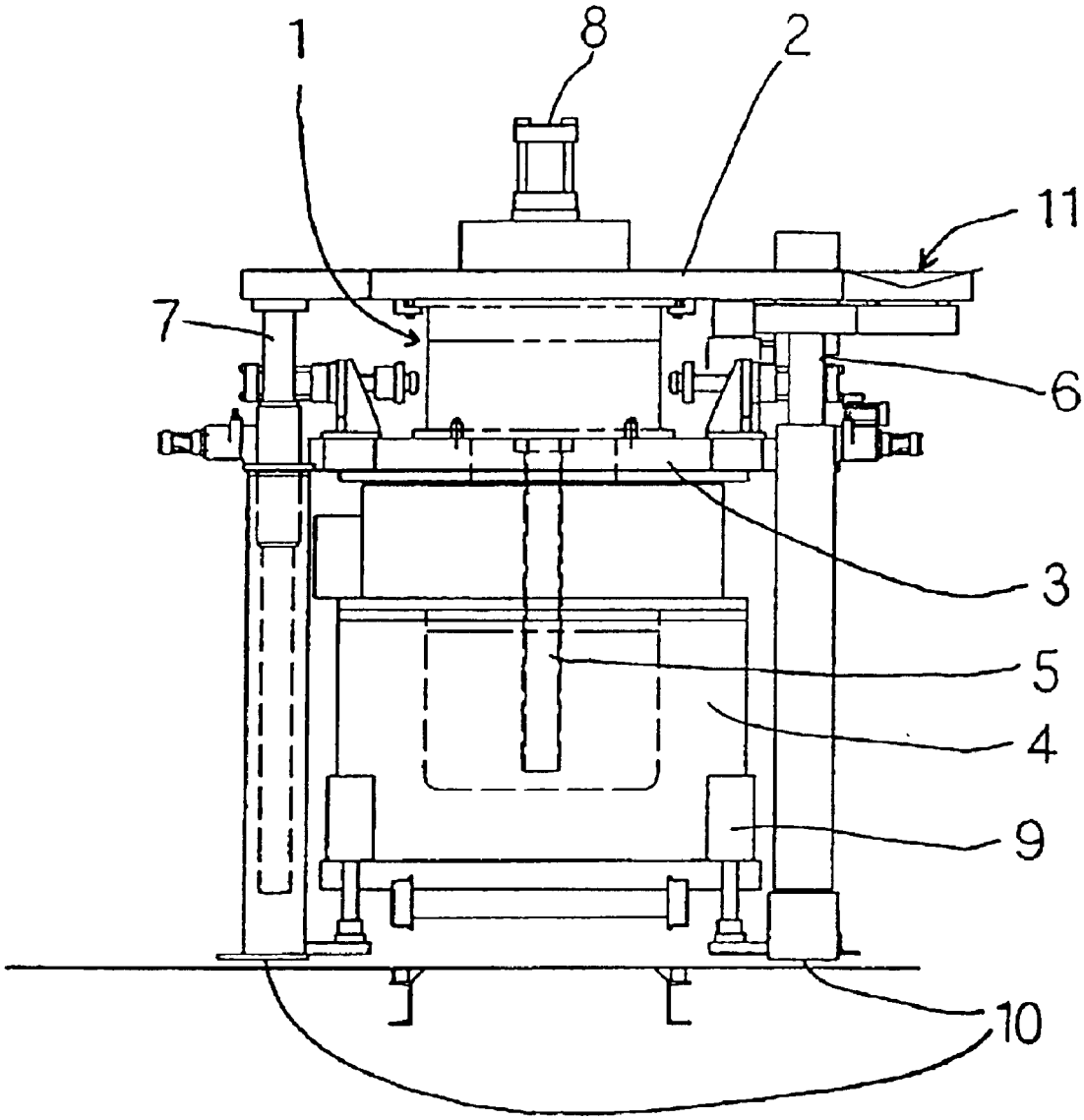
FIG. 2 is a front view similar to FIG. 1, but showing the metal molds being closed.

FIGS. 1 and 2 are schematic front views, partly in section, of a first embodiment of the casting machine of the present invention, with molds 1 (a cope 1*a* and drag 1*b*) of the casting machine being opened in FIG. 1, while being closed in FIG. 2. In this embodiment the casting machine is a low pressure casting machine.

The cope die base 2 is secured to the distal ends of the cylinder rods 6*b* of the upwardly-facing cylinders 6. The cope die base 2 horizontally carries the cope 1*a* above the drag 1*b* and includes an ejector cylinder 8 for ejecting an as-cast product from the metal cope 1*a*.

The cope 1*a* and the drag 1*b* are releasably attached to a cope die base 2 and a drag die base 3, respectively, by bolts or conventional devices. A plurality of (for example, two or four) upwardly-facing oil hydraulic cylinders 6 are placed on a floor around an inner space that contains the drag 1*b*, with their base 10, attached to their lower ends, being placed on the floor, while the drag die plate 3 is fixedly mounted on the cylinders 6 through brackets. In FIGS. 1 and 2, only one oil hydraulic cylinder 6 is seen, at the right. Each cylinder 6 has a cylinder tube 6*a*, a cylinder rod 6*b*, and an inner guiding rod 6*c* along which the cylinder rod 6*b* slides to extend from and retract into the cylinder tube 6*a*. Each cylinder 6 has an oil fluid chamber 6*d* into which working fluid is introduced for extending the cylinder rod 6*b* and another oil fluid chamber 6*e* into which working fluid is introduced for retracting it.

Generally, in a casting machine of the type as in the present invention a greater force is required to open the molds when the molds are closed than to close the molds when they are separated. To meet this requirement the cross-sectional area of the oil fluid chamber 6*d* that receives the pressure of the working fluid is greater than that of the oil fluid chamber Be that receives the pressure of the working fluid, so that a greater force by the cylinder 6 is obtained in the mold opening step than the mold closing step.

The cope die base 2 is secured to the distal ends of the cylinder rods 6*b* of the upwardly-facing cylinders 6. The cope die base 2 horizontally carries the cope 1*b* above the drag 1*b* and includes an ejector cylinder 8 for ejecting an as-cast product from the metal cope 1*a*.

Since the inner guiding rods 6*c* guide the cylinder rods 6*b* to slide along them, the cope die base 2 and the metal cope 1*a* are moved vertically and smoothly, while they are being kept horizontal. Further, since the inner guiding rods 6*c* are provided, less working fluid can be used, and-the diameter of each cylinder rod 6*b* can be made greater than that of the piston rod of an ordinary oil hydraulic cylinder. Thus the horizontal displacement of the cylinder rods 6*b* will be smaller, and the metal cope 1*a* can be moved vertically and smoothly, while being kept horizontal. In other words, the molds 1*a* and 1*b* are properly closed to define a cavity therein when the cylinders 6 are retracted from the position shown in FIG. 1 to their mold-closing position, shown in FIG. 2, and the molds are properly opened from their closing position, shown in FIG. 2, to the positions shown in FIG. 1 to demold the as-cast product.

In this embodiment at least one columnar member 7 (seen at the left in FIGS. 1 and 2, opposite the cylinder 6 shown at the right) is disposed between the cylinders 6 in the circumferential direction. The columnar member 7 is mounted at its proximal end on the base 10 of the cylinders 6 and connected at its distal end to the cope die base 2 and has a wedge-like mechanism for locking the cope die base 2 so that the member 7 acts as a guide for guiding the vertical movement of the cope die base 2 and also acts as means for preventing the cope die base 2 from descending due to the wedge-like mechanism when the oil fluid stops flowing.

A holding furnace 4 is disposed under the drag die base 3 and in the inner space. The holding furnace 4 is connected to the drag 1*b* through a stalk 5 and vertically moved by lifting cylinders 9.

Below the operation of the low pressure casting machine shown in FIGS. 1 and 2 is explained.

At the state of the casting machine shown in FIG. 1, working fluid is fed into the oil fluid chamber 6*e* to retract the cylinder rods 6*b* to lower and mate the metal cope 1*a* with the metal drag 1*b*. Thus the molds 1*a* and 1*b* are closed as in FIG. 2. Then molten metal is poured into the molds by applying a force to it and then cooled. A pressurized fluid is then introduced into the oil fluid chamber 6*d* for extending the cylinder rods 6*b* to lift and separate the metal cope 1*a* from the metal drag 1*b*. Thus the molds 1*a* and 1*b* are opened.

The operation then proceeds to a step of taking out an as-cast product from the metal cope 1*a*, wherein the product is withdrawn from the metal cope 1*a* by the ejecting cylinder 8 and then transported away from the casting machine by a device 11 for taking out a product.

While pouring molten metal the holding furnace 4 is moved upwardly by the lifting cylinders 9 so that the upper surface of the stalk 5 and the gate of the drag 1*b* are connected. A wedge mechanism (not shown) may be used to prevent the holding furnace 4 from descending in case of an emergency where a fluid pump (not shown) stops or a like case. Instead of the wedge mechanism, fluid circuits may be used to prevent the holding furnace from descending.

Figure 3:
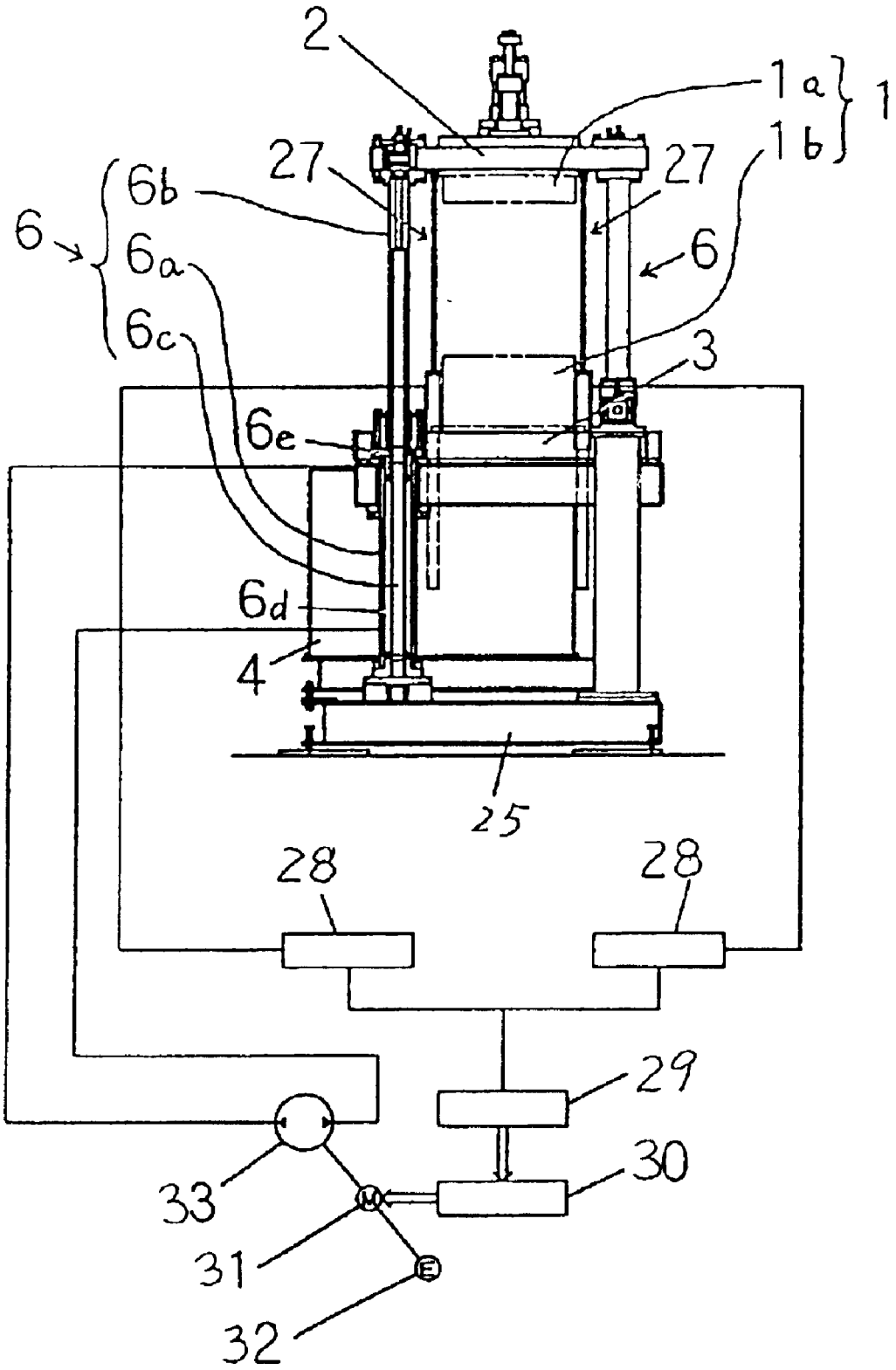
FIG. 3 is a schematic front view, partly in section, of a second embodiment of the casting machine of the present invention.

The second embodiment of the casting machine of the present invention is now explained by reference to FIG. 3. The casting machine of this embodiment is a low pressure casting machine, as in the first embodiment.

Two upwardly-facing oil hydraulic cylinders 6, 6 are placed on a floor around or at the sides of the drag 1*b*, with their base 25, which is attached to their lower ends, being placed on the floor. The upwardly-facing cylinders 6, 6 (including their elements 6*a*–6*e*), the cope 1*a*, the drag 1*b*, the cope die base 2, the drag die base 3, and the holding furnace 4 are arranged in the same manner as in the first embodiment, shown in FIGS. 1 and 2. The stalk (stalk 5 in FIGS. 1 and 2) is not shown in FIG. 3 (i.e., it is omitted). The casting machine of the second embodiment does not have any columnar member that corresponds to the columnar member 7 of the first embodiment.

The casting machine of the second embodiment includes two linear encoders 27, 27 located near the sides of the metal cope la for detecting the displacement of the metal cope. Each of the linear encoders 27, 27 is connected to a single microcomputer (calculating means) 29 through a position counter 28. Further, the microcomputer 29 is electrically coupled to a servomotor 31 through a servo-amplifier 30, and the servomotor 31 in turn is electrically coupled to an encoder 32 and an oil hydraulic pump 33. The oil hydraulic pump 33 is connected via a pipe or hose to one of the upwardly-facing cylinders 6, 6 (the left one in FIG. 3). The other cylinder 6 (the right one in FIG. 3) is connected to another oil hydraulic pump (not shown).

The operation of the casting machine, which is so arranged as described above, is now explained. At the state of the machine as shown in FIG. 1, working fluid is introduced into the oil fluid chambers 6*e*, 6*e* of the oil hydraulic cylinders 6, 6 to retract their cylinder rods (piston rods) 6*b*, 6*b* to lower the cope die base 2 and the metal cope 1*a* to mate the metal cope with the metal drag 1*b*. Thus the molds 1*a*, 1*b* are closed.

In this mold closing step, first, the displacement of the metal cope 1*a* from a predetermined position as, for example, the fixed position of the metal drag 1*b* in this embodiment, is detected by the linear encoders 27, 27 at two horizontally different positions near the sides of the metal cope where the encoders 27, 27 are present. The two detected values of the displacement of the metal cope 1*a* are displayed in the position counters 28, 28. One value of the displacement (detected by the right encoder 27 in FIG. 3) is referred to as a reference value, and the difference between the other value of the displacement (detected by the left encoder 27 in FIG. 3) and the reference value, namely, the displacement differential, is calculated by the microcomputer 29.

In order to cancel the displacement differential, the vertical movement (i.e., the degree of extension or retraction) of the cylinder rod 6*b* of the left cylinder 6 is adjusted so that the degree becomes equal to that of the cylinder rod of the right cylinder 6.

This method is now explained in detail. The microcomputer 29 sends a signal that represents the displacement differential to the servomotor 31 through the servo-amplifier 30 to change the number of rotations of the servomotor 31 to a necessary one. The change of the number of rotations controls the output amount of the fluid discharged from the oil hydraulic pump 33, thereby adjusting the degree of extension of the cylinder rod 6*b* of the left cylinder 6 to conform the degree of extension of the left cylinder rod to that of the right cylinder rod. When the servomotor 31 is operated, the number of rotations of it is measured by the encoder 32. Thus during the mold closing step the metal cope 1*a* is held horizontally.

After the molds are closed, molten metal is poured into the molds and then cooled.

Working fluid is then fed into the oil fluid chambers 6*d*, 6*d* for extending the cylinder rods 6*b*, 6*b* to lift the cope die base 2 to separate the metal cope 1*a* from the metal drag 1*b*, thereby completing the die opening step. In the die opening step, also the operation to horizontally hold the metal cope 1*a*, as explained above, is carried out.

Figure 4:
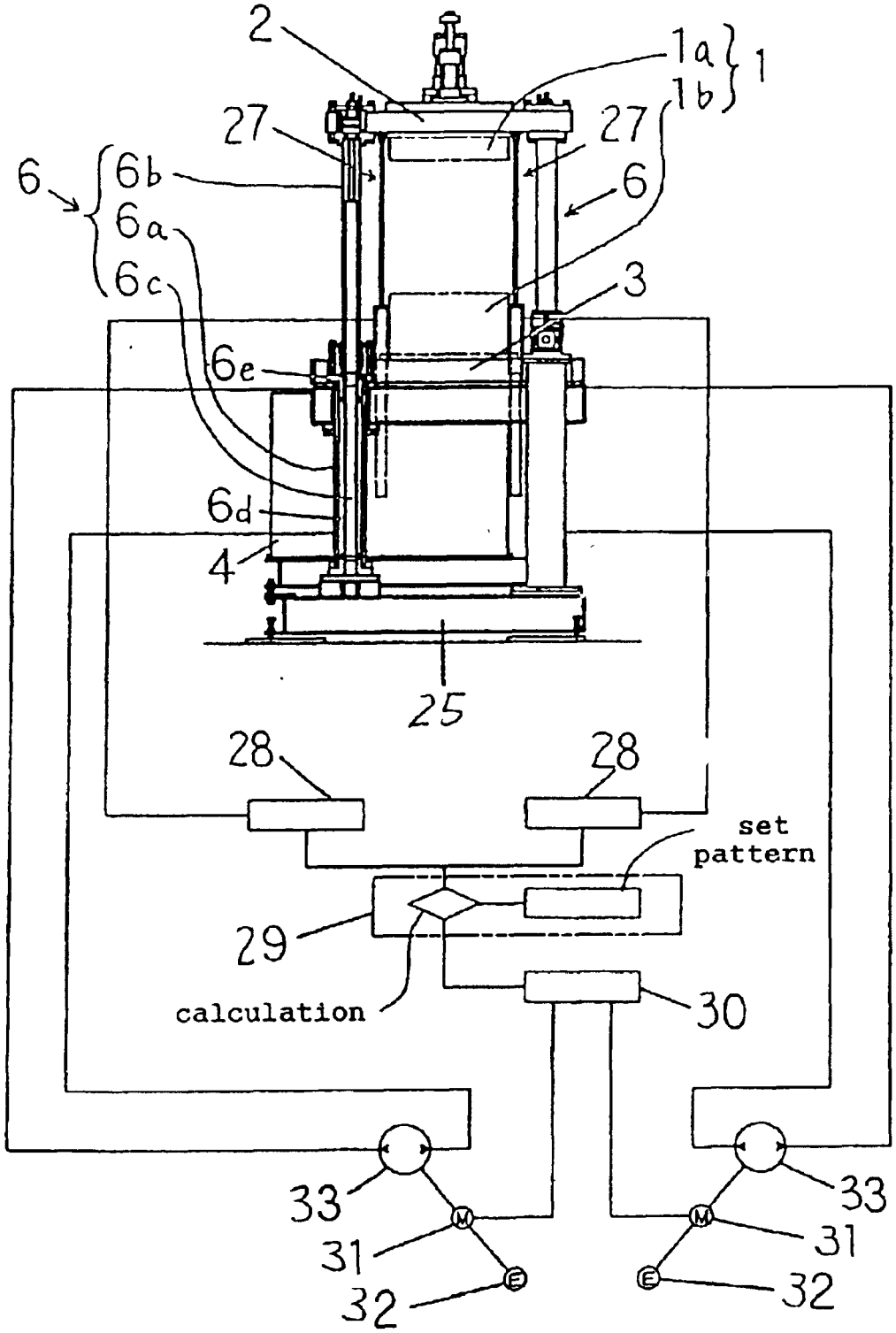
FIG. 4 is a schematic front view, partly in section, of a third embodiment of the casting machine of the present invention.

The third embodiment of the casting machine of the present invention is explained by reference to FIG. 4. This embodiment is the same as the second embodiment, shown in FIG. 3, except that the servomotor 31, the encoder 32, and the oil hydraulic pump (pressure pump) 33 are provided for each cylinder 6.

The operation of the casting machine of the third embodiment is now explained. In a mold closing step of the operation, in the same manner as in the second embodiment the displacement of the metal cope 1*a*, from the metal drag 1*b*, is detected at two horizontally different positions by the linear encoders 27, 27. Two displacement differentials are calculated by the microcomputer 29, by deducting the value of the scheduled displacement in the set pattern in FIG. 5 (here, the set pattern for mold closing) from the detected values of the displacement at the two positions.

To cancel the displacement differentials, the extension of the cylinder rods 6*b* is adjusted so that the displacements of the metal cope 1*a* become equal at the two positions. This is carried out in the same manner as in the second embodiment. In the third embodiment the output volume of the working fluid discharged from both oil hydraulic pumps 13 and 13 is controlled to adjust the extension of the cylinder rods 6*b* to make equal the displacements of the metal cope at the two positions.

Figure 5:
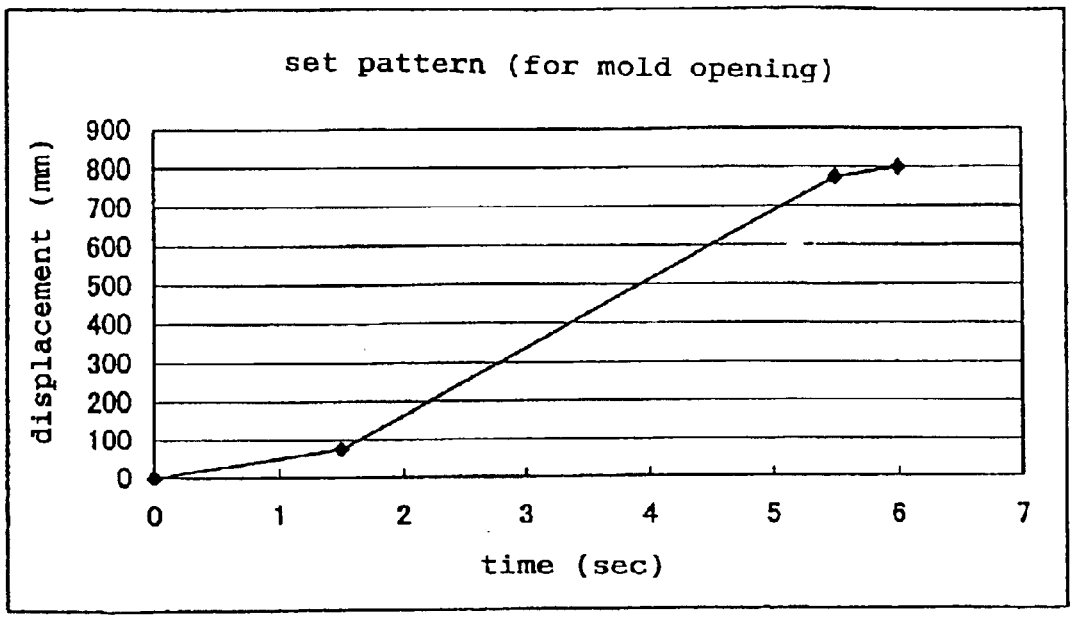
FIG. 5 shows set patterns for opening and closing the metal molds of the casting machine of FIG. 4.
Figure 5:
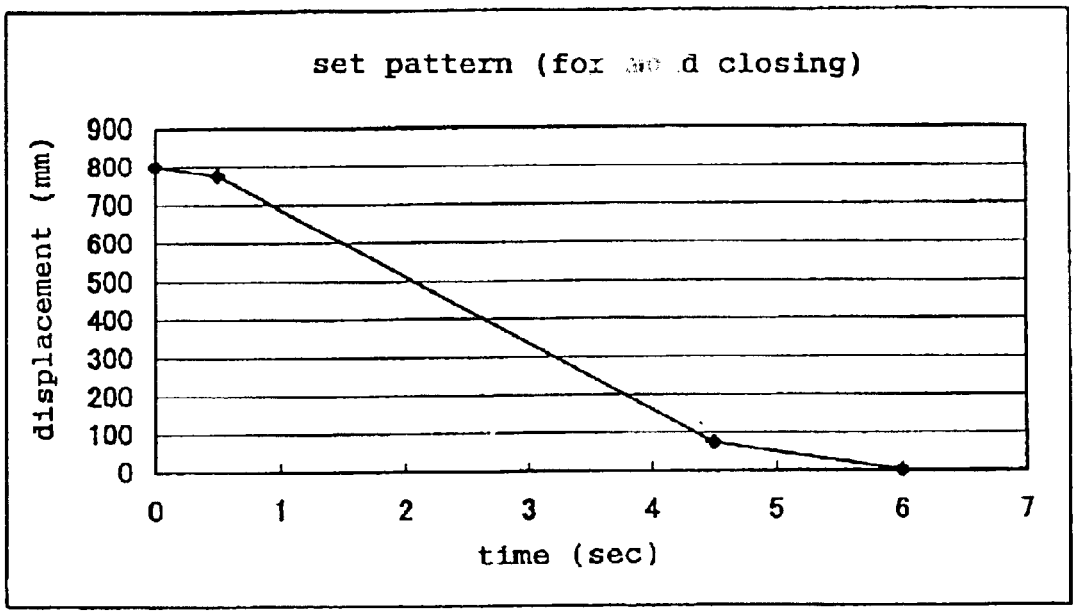

During the mold opening step of the third embodiment the metal cope 1*a* is also held horizontally in the same manner as in the mold opening step. The set pattern for the mold closing step is also shown in FIG. 5.

Although in the third embodiment, as described above, the metal cope is controlled to be held horizontally during both the mold opening and mold closing steps by adjusting the extension of the cylinder rods 6*b*, the control of the metal cope may be done either during the mold opening or closing step.

Preferably, the control of the metal cope is continuously performed during the mold opening or closing step or both. However, it may be timely performed several times per step.

Although in this embodiment two upwardly-facing cylinders and two linear encoders are used, more than two cylinders and two linear encoder may be used. If, for example, four cylinders 6 and four linear encoders 27 are used, the displacement of the metal cope 1*a* may be detected at four positions, allowing a more accurate control of the metal cope.

Further, although in the embodiment the extension of cylinder rods 6*b* is controlled by adjusting the output amount of the working fluid of the oil hydraulic pumps 13 to change the number of rotations of the servomotors 11, instead, for example, a proportional valve or a flow control valve may be used to adjust the output amount of the working fluid. When a proportional or a flow control valve is used, the signals that represent the displacement differentials are sent to a controller, which is electrically coupled to the valve. The controller then controls the amount of the working fluid that is fed to the upwardly-facing cylinders 6 through the valve, to adjust the extension of the cylinder rods 6*b*.

Further, in the embodiment the oil hydraulic cylinders 6 are used as cylinders for vertically moving the metal cope 1*a* relative to the metal drag 1*b*. However, it would be apparent to one skilled in the art that instead of the oil hydraulic cylinders, electric cylinders 6 (servomotor-driven cylinders), each of which has a cylinder rod 6*b* that extends and retracts, can be used. When electric cylinders are used, the number of rotations of each of their servomotors is controlled to adjust the extension of its cylinder rod. Since controlling a servomotor-driven cylinder is well known in the art, a further description about it is omitted here.

In the first, second, and third embodiments, the cope die base 2 and the plurality of upwardly-facing cylinders 6 are rigidly connected. However, the cope die base 2 and upwardly-facing cylinders 6 may be releasably connected by using a clamper to allow the cope die base 2 to become free to expand or contract when subjected to heat stresses, without causing horizontal forces on the upwardly-facing cylinders 6, i.e., without causing horizontal displacement of the cylinders 6, and to allow the cope die base to be separated from the upwardly-facing cylinders 6.

Figure 6:
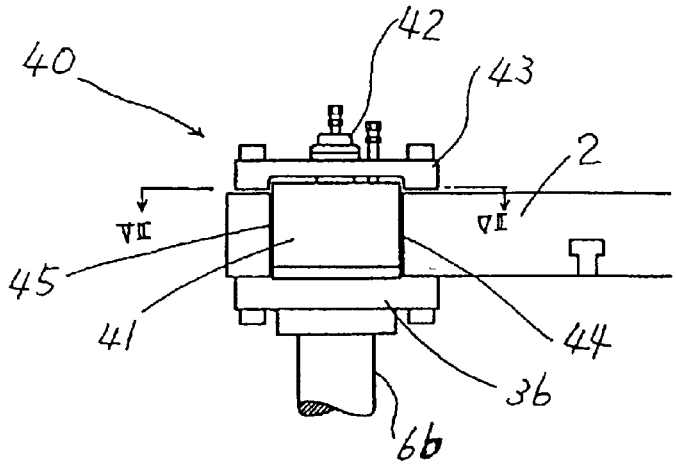
FIG. 6 is an example of a clamping device used for the molding machines of the first, second, and third embodiments.
Figure 7:
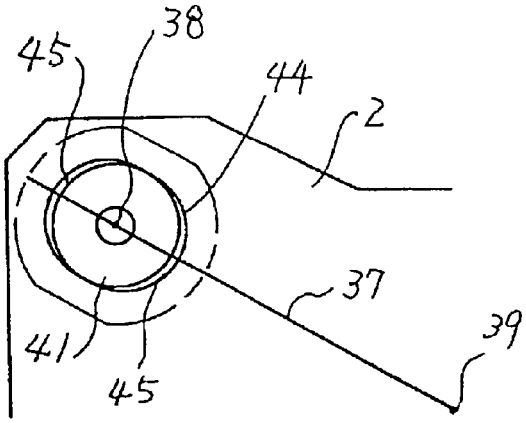
FIG. 7 is a plan view taken along line VII—VII in FIG. 6.
Figure 9:
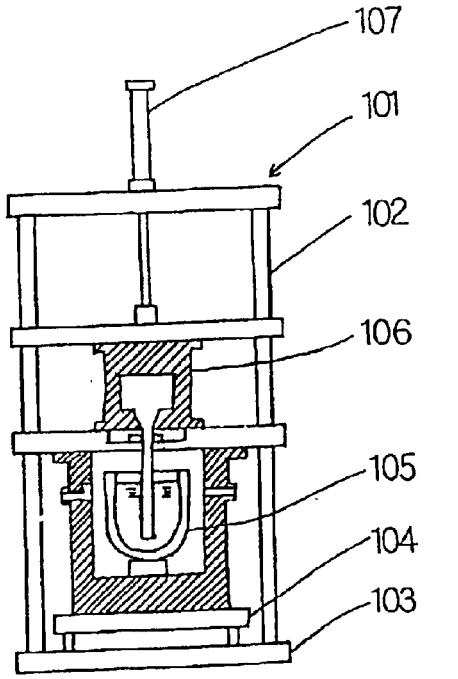
PRIOR ART FIG. 9
FIG. 9 is a front view of a prior-art casting machine.

FIGS. 6 and 7 show an example of such a damper 40 and an example of the associated die base 2. The damper 40 includes a clamping cylinder 41 provided with a piston rod 42 on which a clamping member 43 is mounted. The clamping cylinder 41 is mounted on the distal end 36 of the cylinder rod 6*b* of each upwardly-facing cylinder 6. The die base 2 has elongated circular or oval throughbores 44 for receiving the clamping cylinders 41 so that there is play or are voids 45 between the outer surface of the clamping cylinder 41 and the edge of the throughbore 44 in the direction of a line 37 that connects the center 38 of the throughbore 44 and the center of the cope die base 2.

Accordingly, the dampers 40 fasten, or lock, the cope die base 2 with respect to the upwardly-facing cylinders by lowering their clamping members 42 to press the cope die base against the distal ends 36 of the cylinder rods 6*b*. When desired, the clampers 40 release or unlock the cope die base from the upwardly-facing cylinders by extending the piston rods 42 to lift, or unlock, the clamping members 43 from the cope die base. The dampers 40 may be timely actuated to unlock and lock the cope die base during the mold closing step or the mold opening step. When the dampers 40 are actuated to unlock the cope die base, thanks to the play 45, the cope die base 2 becomes free to expand or contract when subjected to heat stresses from the molds 1*a*, 1*b* or from the environment, since it expands or contracts in the direction of the line 37.

It would be apparent to one skilled in the art that another type of damper can be used, which does not require the throughbores 44 in the cope die base, and which can lock the cope die base from the outside of it, while allowing it to expand or contract when it is unlocked.

Figure 8:
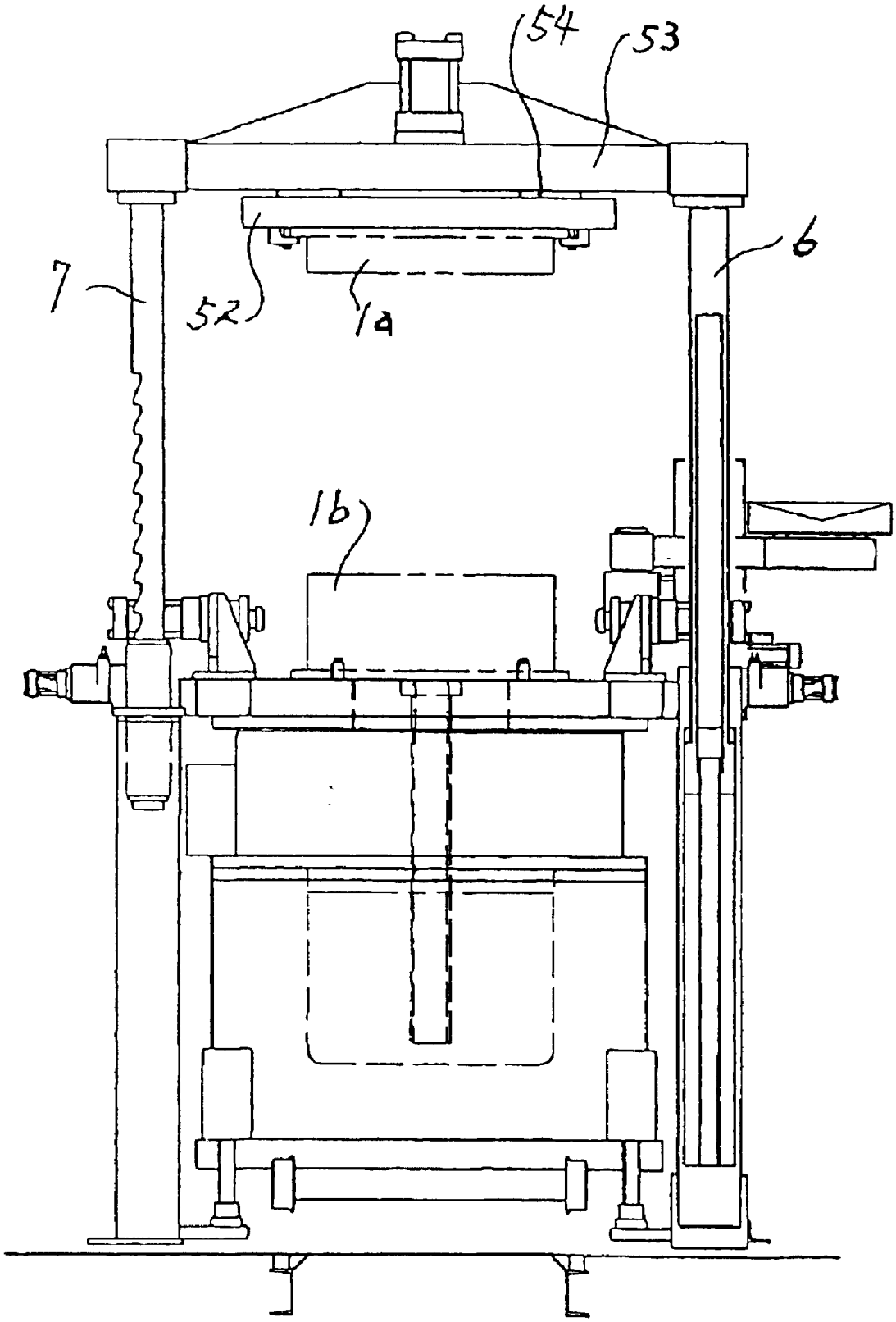
FIG. 8 is a front view of a fourth embodiment of the casting machine of the present invention.

FIG. 8 shows the fourth embodiment of the casting machine of the present invention. The casting machine of this embodiment is the same as that of the first embodiment, shown in FIG. 1, except that a cope die base 52, which carries the cope 1*a*, is connected to the upwardly-facing cylinders 6 through a frame 53. As seen in FIG. 8, the cope die base 52 is attached to the frame 53 through an insulating member or members 54. Thus the heat from the molds 1*a*, 1*b* is not transmitted to the frame 53 or upwardly-facing cylinders 6. The frame 53 is rigid enough such that it is not subjected to harmful strains or torsion during the operation of the casting machine.

Some embodiments and examples of the present invention, which are explained above, are exemplary only and it is not intended to limit the present invention to them. It would be clear to one skilled in the art that many variations and modifications can be made to the embodiments and examples without departing from the sprit and scope of the present invention. Thus the appended claims are intended to include such variations and modifications.

What is claimed is:

1. A casting machine for producing an as-cast product in horizontally split metal molds that can be closed to define a cavity and by pouring a molten metal from a holding furnace into the cavity, comprising:

a metal drag held horizontally at a fixed position;

a plurality of upwardly-facing cylinders disposed around the metal drag and mounted on a floor or a base, each cylinder having a cylinder rod that extends upwardly and retracts;

and a cope die base mounted for vertical movement on the distal ends of the cylinder rods of the upwardly-facing cylinders for horizontally holding a metal cope at a position above the metal drag so that the metal cope is mated with the metal drag to define the cavity when the cope die base is lowered by the upwardly-facing cylinders;

detecting means for detecting vertical displacements of the metal cope at horizontally separate points from the metal drag;

calculating means electrically coupled to the detecting means for calculating a displacement differential between the displacements of the meal cope at the horizontally separate points; and means for adjusting the extension of the cylinder rods to cancel the displacement differential to horizontally hold the metal cope based on the displacement differential from the calculating means.

2. The casting machine of claim 1, wherein the upwardly-facing cylinders are oil hydraulic cylinders.

3. The casting machine of claim 1, wherein the upwardly-facing cylinders are electric cylinders.

4. The casting machine of claim 1, further including clampers for connecting and locking the cope die base to the cylinder rods of the upwardly-facing cylinders, the clampers allowing the cope die base to expand and contract and also to be supported by the cylinder rods when the clampers are unlocked.

5. The casting machine of claim 1, wherein each of the clampers has a second cylinder mounted on the distal end of the cylinder rod of each upwardly-facing cylinder, the second cylinder having a clamping member for locking the cope die base, the cope die base having throughbores for receiving the second cylinders of the clampers, each throughbore having play or a sufficient size between an edge thereof and an outer surface of the second cylinder in the direction of a line that passes through the center of the throughbore and the center of the cope die base such that when the clampers are unlocked, the cope die base can expand and contract when subjected to heat stresses without causing a horizontal force on the upwardly-facing cylinders.

6. A method for producing an as-cast product comprising the steps of:

providing a casting machine having a plurality of upwardly-facing cylinders placed on a floor or a base, the cylinders being placed around an inner space, each cylinder having a cylinder rod that extends upwardly and retracts; a metal drag horizontally and fixedly mounted on the upwardly-facing cylinders in the inner space; a holding furnace disposed under the metal drag and in the inner space; and a cope die base mounted for vertical movement on distal ends of the cylinder rods of the upwardly-facing cylinders for horizontally holding a metal cope at a position above the metal drag so that the metal cope is mated with the metal drag to define a cavity when the cope die base is lowered by the upwardly-facing cylinders;

retracting the cylinder rods to mate the metal cope with the metal drag, thereby closing the metal cope and the metal drag to define the cavity;

during said closing, detecting vertical displacements of the metal cope at horizontally separate points from the metal drag as the metal cope is moved downward by the upwardly-facing cylinders;

calculating a displacement differential between the displacements of the metal cope detected at the horizontally separate points adjusting the extension of the cylinder rods to cancel the displacement differential to horizontally hold the metal cope based on the calculated displacement differential;

pouring molten metal from the holding furnace into the cavity and then cooling the molten metal; and extending the cylinder rods so that the metal cope is held horizontally, thereby opening the molds to separate the metal cope from the metal drag.

7. The method of claim 6, wherein the mold opening step further includes the steps of:

detecting vertical displacements of the metal cope at horizontally separate points from the metal drag when the metal cope is moved upward by the upwardly-facing cylinders;

calculating a displacement differential between the displacements of the metal cope detected at the horizontally separate points; and adjusting the extension of the cylinder rods to cancel the displacement differential to horizontally hold the metal cope based on the calculated displacement differential.

8. A method for producing an as-cast product comprising the steps of:

providing a casting machine having a plurality of upwardly-facing cylinders placed on a floor or a base, the cylinders being placed around an inner space, each cylinder having a cylinder rod that extends upwardly and retracts; a metal drag horizontally and fixedly mounted on the upwardly-facing cylinders in the inner space; a holding furnace disposed under the metal drag and in the inner space; and a cope die base mounted for vertical movement on distal ends of the cylinder rods of the upwardly-facing cylinders for horizontally holding a metal cope at a position above the metal drag so that the metal cope is mated with the metal drag to define a cavity when the cope die base is lowered by the upwardly-facing cylinders;

retracting the cylinder rods to mate the metal cope with the metal drag, thereby closing the metal cope and the metal drag to define the cavity;

during said closing, detecting vertical displacements of the metal cope at horizontally separate points from the metal drag as the metal cope is moved downward by the upwardly-facing cylinders;

calculating displacement differentials between the displacements of the metal cope detected at the horizontally separate points and a scheduled displacement in a mold closing set pattern;

adjusting the extension of the cylinder rods to cancel the displacement differentials to horizontally hold the metal cope based on the calculated displacement differentials;

pouring molten metal from the holding furnace into the cavity and then cooling the molten metal; and extending the cylinder rods so that the metal cope is held horizontally, thereby opening the molds to separate the metal cope from the metal drag.

9. The method of claim 8, wherein the mold opening step further includes the steps of:

detecting vertical displacements of the metal cope at horizontally separate points from the metal drag when the metal cope is moved upward by the upwardly-facing cylinders;

calculating displacement differentials between the displacements of the metal cope detected at the horizontally separate points and a scheduled displacement in a mold opening set pattern; and adjusting the extension of the cylinder rods to cancel the displacement differentials to horizontally hold the metal cope based on the calculated displacement differentials.

10. The method of claim 6 or 8 wherein an output force of the upwardly-facing cylinders in the mold opening step is greater than that in the mold closing step.

11. A method for producing an as-cast product, comprising the steps of:

providing a casting machine having a plurality of upwardly-facing cylinders placed on a floor or a base, the cylinders being placed around an inner space, each cylinder having a cylinder rod that extends upwardly and retracts; a metal drag horizontally and fixedly mounted on the upwardly-facing cylinders in the inner space; a holding furnace disposed under the metal drag and in the inner space; and a cope die base mounted for vertical movement on distal ends of the cylinder rods of the upwardly-facing cylinders for horizontally holding a metal cope at a position above the metal drag so that the metal cope is mated with the metal drag to define a cavity when the cope die base is lowered by the upwardly-facing cylinders;

retracting the cylinder rods to mate the metal cope with the metal drag, thereby closing the metal cope and the metal drag to define the cavity;

pouring molten metal from the holding furnace into the cavity and then cooling the molten metal;

extending the cylinder rods so that the metal cope is held horizontally, thereby opening the molds to separate the metal cope from the metal drag;

during the opening, detecting vertical displacements of the metal cope at horizontally separate points from the metal drag as the metal cope is moved upward by the upwardly-facing cylinders;

calculating a displacement differential between the displacements of the metal cope detected at the horizontally separate points and adjusting the extension of the cylinder rods to cancel the displacement differential to horizontally hold the metal cope based on the calculated displacement differential.

12. A method for producing an as-cast product, comprising the steps of:

providing a casting machine having a plurality of upwardly-facing cylinders placed on a floor or a base, the cylinders being placed around an inner space, each cylinder having a cylinder rod that extends upwardly and retracts; a metal drag horizontally and fixedly mounted on the upwardly-facing cylinders In the inner space; a holding furnace disposed under the metal drag and in the inner space; and a cope die base mounted for vertical movement on distal ends of the cylinder rods of the upwardly-facing cylinders for horizontally holding a metal cope at a position above the metal drag so that the metal cope is mated with the metal drag to define a cavity when the cope die base is lowered by the upwardly-facing cylinders;

retracting the cylinder rods to mate the metal cope with the metal drag, thereby closing the metal cope and the metal drag to define the cavity;

pouring molten metal from the holding furnace into the cavity and then cooling the molten metal;

extending the cylinder rods so that the metal cope is held horizontally, thereby opening the molds to separate the metal cope from the metal drag;

during the opening, detecting vertical displacements of the metal cope at horizontally separate points from the metal drag as the metal cope is moved upward by the upwardly-facing cylinders;

calculating displacement differentials between the displacements of the metal cope detected at the horizontally separate points and a scheduled displacement in a mold opening set pattern; and adjusting the extension of the cylinder rods to cancel the displacement differentials to horizontally hold the metal cope based on the calculated displacement differentials.

* * * * *